US005844495A

United States Patent [19]

Griessbach

[11] Patent Number: 5,844,495

[45] Date of Patent: Dec. 1, 1998

[54] KEY FOR OPERATING BOTH MOTOR VEHICLE AND BUILDING LOCKS

[75] Inventor: Robert Griessbach, Hoehenkirchen-Siegertsbrunn, Germany

[73] Assignee: Bayerische Motoren Werke Aktiengesellschaft, Munich, Germany

[21] Appl. No.: 711,207

[22] Filed: Sep. 9, 1996

[30] Foreign Application Priority Data

Sep. 8, 1995 [DE] Germany ..... 195 33 309.8

[51] Int. Cl.[6] ..... G08C 17/00

[52] U.S. Cl. ..... 340/825.31; 340/825.34; 340/825.69; 340/825.72; 235/382; 70/256; 70/279; 307/10.2; 180/287

[58] Field of Search ..... 340/825.31, 825.34, 340/825.69, 825.72, 825.3; 235/382; 70/256, 279, 257, 237; 307/10.2, 10.3, 10.6; 180/287

[56] References Cited

U.S. PATENT DOCUMENTS

| | | | |
|---|---|---|---|
| 4,788,542 | 11/1988 | Tanabe | 340/825.31 |
| 5,109,221 | 4/1992 | Lambropoulos et al. | 340/825.89 |
| 5,311,757 | 5/1994 | Spahn | 340/825.31 X |
| 5,442,341 | 8/1995 | Lambropoulos | 340/825.31 |
| 5,467,082 | 11/1995 | Sanderson | 340/825.31 X |
| 5,477,214 | 12/1995 | Bartel | 340/825.69 X |
| 5,534,845 | 7/1996 | Issa et al. | 307/10.2 X |
| 5,561,420 | 10/1996 | Kleefeldt et al. | 640/825.31 |
| 5,648,764 | 7/1997 | Nose et al. | 340/825.31 X |
| 5,650,774 | 7/1997 | Drori | 340/825.31 X |

FOREIGN PATENT DOCUMENTS

| | | |
|---|---|---|
| 0 268 238 | 5/1988 | European Pat. Off. . |
| 0 440 974 | 8/1991 | European Pat. Off. . |
| 38 03 541 | 8/1989 | Germany . |
| 39 27 994 | 2/1991 | Germany . |
| 40 06 125 | 3/1991 | Germany . |
| 40 18 261 | 8/1991 | Germany . |
| 40 25 229 | 2/1992 | Germany . |
| 41 02 816 | 8/1992 | Germany . |
| 42 26 053 | 2/1993 | Germany . |
| 42 05 567 | 8/1993 | Germany . |
| 44 11 435 | 10/1995 | Germany . |
| WO 90/08242 | 7/1990 | WIPO . |

*Primary Examiner*—Brian Zimmerman
*Assistant Examiner*—William H. Wilson, Jr.
*Attorney, Agent, or Firm*—Evenson, McKeown, Edwards & Lenahan, P.L.L.C.

[57] ABSTRACT

A key operable with both motor vehicles and buildings includes a mechanically coded part and a transponder for exchanging an identification code that includes a fixed code and a second code part. The fixed code can be used within the framework of a door-locking system for the building for identifying the key user as the one authorized to enter the building. Both the fixed code and the second code part are used to operate a motor vehicle lock.

11 Claims, 2 Drawing Sheets

KEY FOR OPERATING BOTH MOTOR VEHICLE AND BUILDING LOCKS

BACKGROUND AND SUMMARY OF THE INVENTION

The invention relates to a key and, more particularly, to a key for motor vehicles having a mechanically coded part and a transponder for exchanging an identification code that includes a fixed code and a second code part.

A key of the above-mentioned type is used within the framework of conventional electronic drive-away protection. The second code part can be a changeable code that changes every time it is used, at random or according to a formal law, or can be another fixed code. As a result of a dialog with a transceiver, the fixed code and the second code part are interrogated and the vehicle is permitted to start when both codes conform to expectations. The transceiver is permanently located in the vehicle.

It is conventional nowadays to assign a separate key to each object to be protected. The result is a collection of different keys that is awkward to handle and, in the event of a total loss, makes it necessary to change a number of locks.

The goal of the invention is to provide a key of the above-mentioned type that can be used in a variety of ways.

The invention achieves this goal by providing a key for motor vehicles having a mechanically coded part and a transponder for exchanging an identification code that includes a fixed code and a second code part. The fixed code is usable within the framework of a door-locking system in a home area for identifying the key owner as one who is authorized to enter.

Other objects, advantages and novel features of the present invention will become apparent from the following detailed description of the invention when considered in conjunction with the accompanying drawings.

DETAILED DESCRIPTION OF THE DRAWINGS

Referring to FIGS. 1*a–f*, in the manner of a flow chart, there is shown the dialog between a portable code memory and a code comparator, i.e., a code control unit as referred to herein, fixed to the vehicle. The course of this dialog illustrated in diagrams 1(*a*) to 1(*f*) preferably takes place in a wireless manner.

The code memory S is disposed in a portable housing Z, such as an ignition key. It has a block structure, as known in principle from German Patent document DE 42 05 567 A1. Of the blocks marked with numbers 1 to 7, only blocks 1 to 3 are of interest within the scope of the invention. Block 1 is part of an access control device ACD for blocks 1 to 7 which is provided by a microprocessor ($\mu$P) in the housing Z (shown only in FIG. 1(*b*) for simplification). The microprocessor interacts with the memory S. The access control device operates in accordance with indicator RFB for the number of the first readable memory block and by RLB for the number of the last-readable memory block. In addition, access to the access control device may be protected by a password. It is important that the access control device can only be controlled by a code control unit V provided or contained in the motor vehicle. The code control unit V is not shown in detail. It is disposed in the motor vehicle and receives the contents of the memory blocks which can be read out of the memory S.

The dialog, which will be explained in the following and by means of diagrams a to f, is to take place, for example, when the mechanical ignition key is inserted and operated in an ignition lock. However, it is just as easily possible to carry out this dialog in a supplementary manner or as a replacement when the motor vehicle is unlocked. For this purpose, the memory S is situated in an ignition key Z which is introduced into a lock which is not shown and, in the process, triggers an inquiry by the code comparator V. The dialog preferably takes place in a wireless manner by means of a coil Sp which is controlled by a transmitter-IC.

The first partial code signal contained in block 3 is read out first (FIG. 1*a*) and is fed into the code control unit V by way of the coil Sp. The indicator RFB contains the designation of the first block 3 which can be read out from the memory S. This first partial code signal contains information which can be individualized for a particular memory S or for a particular key Z. This information is not changed thereafter. This allows the code control unit V to recognize one of several authorized users by means of the key identification contained in block 3.

Figure 1A:
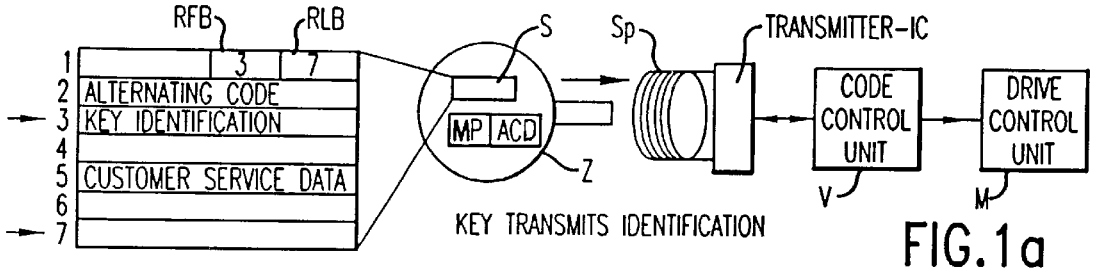
FIGS. 1(*a–f*) are a sequence of flow charts illustrating the dialog between a key and a code control unit fixed to the vehicle.
Figure 1B:
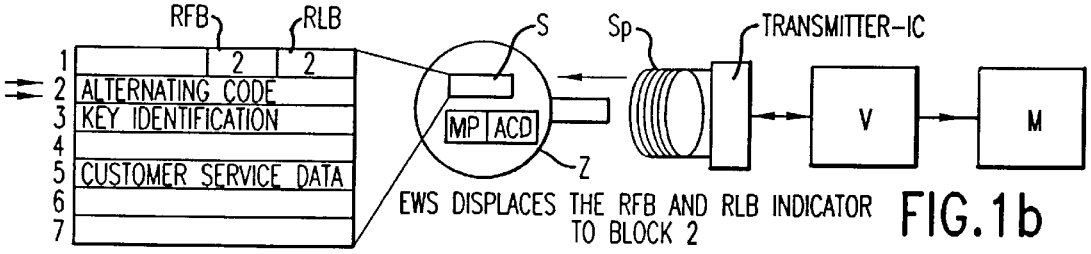
Figure 1C:
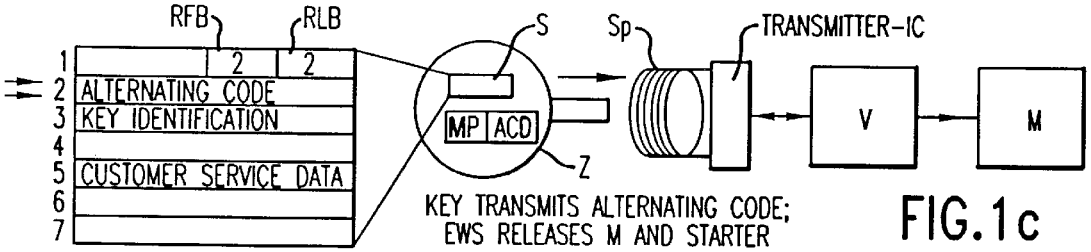

If the first partial code signal corresponds to the reference partial code signal which exists in the code control unit V and is expected by it, the code control unit V will control the indicators RFB and RLB (block 1) in the manner shown in FIG. 1*b* by way of the transmitter-IC and the coil Sp. The information RFB and RLB therefore indicates only block 2 which can be read alone.

The information contained in block 2 represents the second partial code signal which is now read and is compared in the comparator V (FIG. 1*c*) with the corresponding reference partial code signal. If these also coincide, that is, if the entire code signal formed of the two partial code signals is identical with the expected code signal, the code control unit V releases a drive control unit M.

Subsequently, the code control unit V writes back a new second partial code signal. This may be a random number. This number reaches the memory S via the path indicated by an arrow and is stored as a new alternate code in block 2 of the memory S. This operation is illustrated in FIG. 1*d*.

Figure 1D:
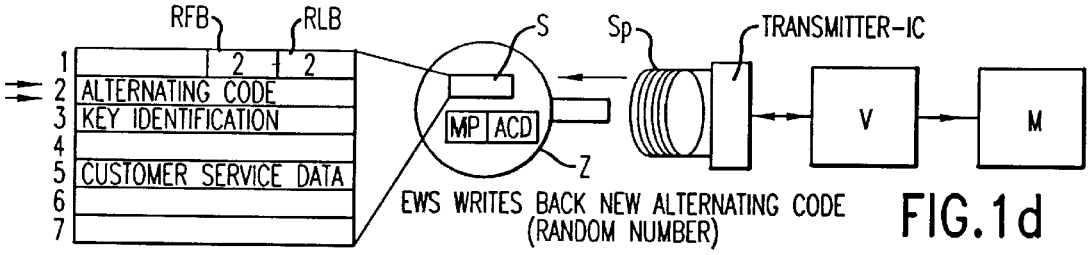
Figure 1E:
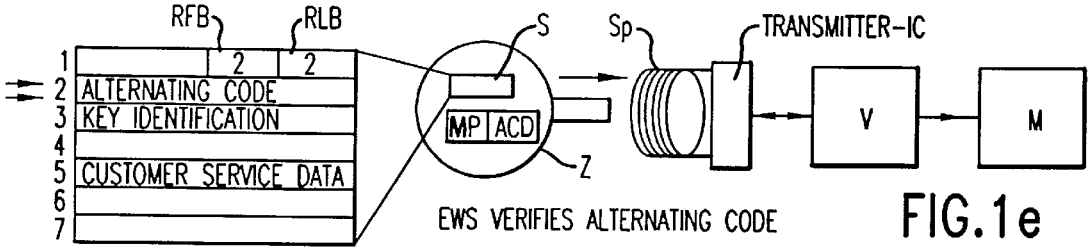
Figure 1F:
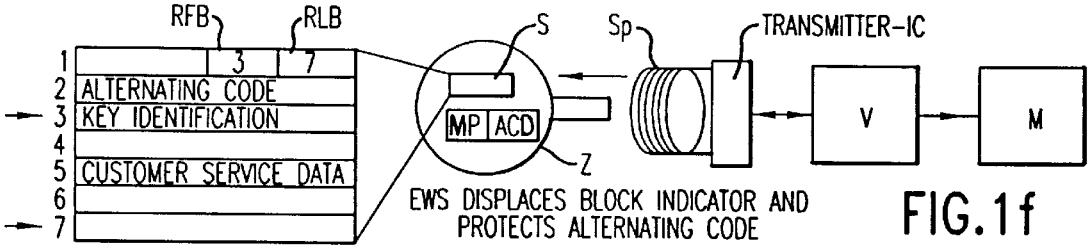

In order to ensure that the alternate code was in fact stored correctly in the memory S, it is read again and is compared in the code control unit (FIG. 1*e*) with the alternate code emitted and stored in the preceding process step (FIG. 1*d*). If the alternate code is identical, the code control unit V changes the content of block 1 again and the original (FIG. 1*a*) existing condition is set. The information in field RFB (=3) means that now block 3 is again read first, while the content of block 2, that is, the alternate code is protected from access.

Therefore, the content of the memory S in step (f) differs from that in step (a) with respect to the content of block 2. This content can no longer be read. On the other hand, it is changed with respect to the first (step a) existing content. The alternate code is therefore protected from being read. On the other hand, should it be possible to nevertheless "break into" the alternate code, it is ensured that, after the next use of the motor vehicle a protection is achieved against misuse as a result of the then again changed alternate code.

Further details regarding the implementation of the key with the motor vehicle are described in co-pending U.S. Ser. No. 08/413,723, filed Mar. 31, 1995, the specification of which is herein expressly incorporated by reference.

Figure 2:
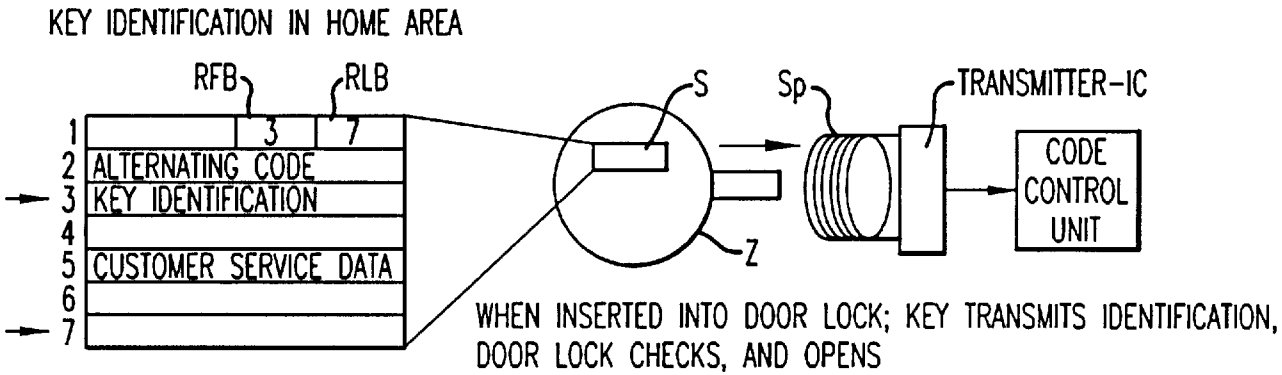
FIG. 2 is an example illustrating the key identification for a house according to the present invention.

As an advantage of the present invention, the fixed code has a multiplicity of functions. Referring to FIG. 2, in addition to its role within the framework of identifying the motor vehicle user, the fixed code is additionally employed to open locks in a home and, possibly, even to lock them. For this purpose, a transceiver similar to the one provided in the motor vehicle is mounted at the door of the home, by which the transponder is interrogated regarding its fixed code. On the basis of the fixed code, a determination is made as to whether the authorized resident is in fact present. The key can be a house key, garage key, or the like. This door is opened with the aid of the key, so that unlocking with the aid of a mechanically coded key is eliminated.

In comparison to FIG. 1, only the fixed code, i.e., key identification block or cell 3, is used in the home. The alternating code, i.e., alternating code block or cell 2, remains unchanged. Hence, the stepwise read out of the fixed code and the second part are not necessarily performed when the key is used for a home lock. Instead, the key is used without any changes being made to its code. As shown in FIG. 2, instead of the use of a drive control unit V, the house door lock is opened.

To increase convenience, provision can be made such that when the fixed code matches the anticipated fixed code, an automatic door opener is triggered. In this way, information is delivered acoustically regarding the successful comparison of the fixed code stored in the key with the anticipated fixed code.

Advantageous embodiments of the invention relate to the improvement in the benefit of use. Thus, the door-locking system can be synchronized with the fixed code of the key. This is necessary when the fixed code changes. It can also involve the possibility known from German patent document DE 29 28 913 C (corresponding to U.S. Pat. No. 4,347,545, the specification of which is expressly incorporated by reference herein) of making the fixed code basically variable as well. In contrast to changing a variable code, however, this change is possible only at considerable expense and with the observation of safety measures to prevent unintended changes. The change in the fixed code, as a rule, also takes place when the motor vehicle is changed. It is also conceivable in this respect in such cases to not change the fixed code and to synchronize the fixed code of the motor vehicle with the fixed code of the key.

Two fixed codes can be synchronized in different ways. One example is provided in European patent document EP 106 273 B (corresponding to U.S. Pat. No. 4,652,860, the specification of which is expressly incorporated by reference herein). In this document, the synchronization of two transmitters that emit a coded signal is basically described.

While up to this point the opening of doors in the home with the aid of the motor vehicle key has been considered, the reverse case will be considered in the following. Since a motor vehicle as a rule is or may be used by only a small group of persons in a community, a different key can be provided for that group of persons who are supposed to have access to the home only. This key can contain only the fixed code. Such a "slimmed down" key does not allow operation of the motor vehicle.

Of course, it is also possible to use only the second code part, preferably in the form of a changing code. A key provided only with the changing code can cover another application, for example in the hotel area, where protection against interception is of primary importance and is ensured by always changing the code each time it is used or after a specified number or types of use.

The invention also allows the size of the key bundle to be reduced, since separate house keys for the user of the motor vehicle are eliminated. At the same time, the safety of the locking system of the home is increased by replacing the usual mechanical locking system by the electronic changing code. The possibility of economical manufacture of a home-locking system by using motor vehicle parts that are produced in large quantities and are safe and reliable is particularly important.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A key for a motor vehicle and a house, comprising:

a mechanically coded part;

a transponder for exchanging an identification code which includes a fixed code and a second code part;

wherein said fixed code is applied to a door-locking system for a house area in order to identify a key owner as one authorized to enter the house area; and wherein said fixed code and said second code part are applied to the motor vehicle for operating a motor vehicle lock.

2. The key according to claim 1, further comprising an automatic door opener triggered when the identification of said key owner is successful.

3. The key according to claim 2, wherein said door-locking system is synchronized with the fixed code of said key for the motor vehicle.

4. The key according to claim 3, further comprising an additional key having a transponder containing only said fixed code.

5. The key according to claim 2, further comprising an additional key having a transponder containing only said fixed code.

6. The key according to claim 1, further comprising an additional key having a transponder containing only said fixed code.

7. A security system, comprising:

a motor vehicle lock;

a building door-lock system for securing a building area;

a key operable with both the motor vehicle lock and the building door-lock system, said key comprising a mechanically coded part, a memory storing at least a two part identification code including a fixed code part and a second code part, and a transponder for exchanging the identification code;

wherein both the fixed code part and the second code part operate the motor vehicle lock, and only the fixed code part operates the building door-lock system in order to identify a key owner as one authorized to enter the building area.

8. The security system according to claim 7, wherein the building door-lock system is a home door-lock system.

9. The security system according to claim 7, further comprising an automatic door opener coupled with the building door-lock system, said automatic door opener operating when the identification of the key owner is successful.

10. The security system according to claim 7, further comprising an additional key having a transponder which exchanges only the fixed code.

11. A key for operating both a motor vehicle lock and a building lock, comprising:

a mechanically coded part; and an electronically coded part, said electronically coded part having a particular coding scheme;

wherein the entire particular coding scheme operates one of the motor vehicle lock and the building lock, and only a portion of the particular coding scheme operates the other of the motor vehicle lock and the building lock.

* * * * *